United States Patent [19]

Möller

[11] 4,281,822

[45] Aug. 4, 1981

[54] DEVICE FOR CUTTING A WORK PIECE MANUFACTURED IN A CONTINUOUS CASTING PLANT

[75] Inventor: Karlheinz Möller, Obertshausen, Fed. Rep. of Germany

[73] Assignee: Messer Griesheim GmbH, Frankfurt am Main, Fed. Rep. of Germany

[21] Appl. No.: 66,509

[22] Filed: Aug. 14, 1979

[30] Foreign Application Priority Data

Sep. 29, 1978 [DE] Fed. Rep. of Germany ..... 2842503

[51] Int. Cl.[3] ..... B23K 7/00

[52] U.S. Cl. ..... 266/50; 266/69; 164/263

[58] Field of Search ..... 266/50, 66, 67, 68, 266/69, 71, 77; 164/263

[56] References Cited

U.S. PATENT DOCUMENTS

| | | | |
|---|---|---|---|
| 3,866,892 | 2/1975 | Hooper | 266/69 |
| 3,955,804 | 5/1976 | Gallucci et al. | 266/50 |

FOREIGN PATENT DOCUMENTS 2710564 4/1978 Fed. Rep. of Germany .

*Primary Examiner*—L. Dewayne Rutledge
*Assistant Examiner*—John P. Sheehan
*Attorney, Agent, or Firm*—Connolly and Hutz

[57] ABSTRACT

A device for cutting a wide continuously cast work piece includes a longitudinal cutting device located downstream from the casting plant with a traversal cutting device mounted downstream therefrom.

4 Claims, 3 Drawing Figures

DEVICE FOR CUTTING A WORK PIECE MANUFACTURED IN A CONTINUOUS CASTING PLANT

BACKGROUND OF INVENTION

The present invention relates to a device for cutting a work piece manufactured in a continuous casting plant, e.g., of a slab, block, etc., which comprises both a flame cutting device for transverse cutting and another flame cutting device for longitudinal cutting of the works.

The state of the art is exemplified in German Auslegschrift No. 27 10 564. Attempts to manufacture excessively broad slabs with a breadth of up to 2.50 m, for example, by increasing the casting cross-section of the chill, whereby an increase in the capacity of a continuous casting plant is achieved, make it necessary to subject the slabs of such size to further processing immediately. This is, however, only possible if these continuously cast slabs are reduced to a dimension that is convenient for processing, because the breadth of such a continuously cast strip often does not correspond to the rolling width of the subsequent rolling mill. It is necessary for this purpose that the continuously cast slab be cut not only transversely, but also longitudinally into one or several longitudinal strips in view of its "excessive breadth".

In the equipment disclosed in German Auslegeschrift No. 10,564, the strip is first cut into individual pieces by transverse cutting, which pieces are then transported by a separately installed transverse transporting device into the separately installed longitudinal cutting device. Since the cross-cutting of the strip takes place substantially faster than the longitudinal cutting of the cut-off slab piece, it is necessary to combine such a cross-cutting device with at least two longitudinal cutting devices, which leads to substantial investment costs in order to avoid bottlenecks in the operation.

SUMMARY OF INVENTION

It is therefore an object of the present invention to propose a device for the cutting of a work piece manufactured continuously in a continuous casting plant, which is structurally simple and yet guarantees the economical cutting (cross-cutting and longitudinal cutting) of the work pieces.

To accomplish this object, the device according to the present invention is characterized by such an arrangement of the two flame cutting devices that the longitudinal cutting device is installed behind or downstream from the continuous casting plant, and, seen in the direction of the slab discharge, the device for the cross-cutting of the work pieces is installed immediately behind the said longitudinal cutting device.

Through the arrangement of the two flame cutting devices according to the present invention, i.e., with the cross-cutting device behind the longitudinal cutting device, it is sufficient to combine one longitudinal cutting device with a single cross-cutting device. Since the longitudinal cutting is known to always take more time than the cross-cutting, there is no bottleneck due to the longitudinal cutting, as there used to be, although it has been suggested that this could be equalized only by the use of additional longitudinal flame cutting machines.

The cutting speed of the longitudinal flame cutting device is determined by the speed of casting, i.e., the velocity with which the slab is moving forward.

Through the arrangement of the two flame cutting devices according to the present invention, it is further possible to install the two devices very close to each other, so that there is no empty space between these two devices, except for the space necessary for structural reasons, whereby the entire plant has a very small space requirement.

THE DRAWINGS

DETAILED DESCRIPTION

Figure 1:
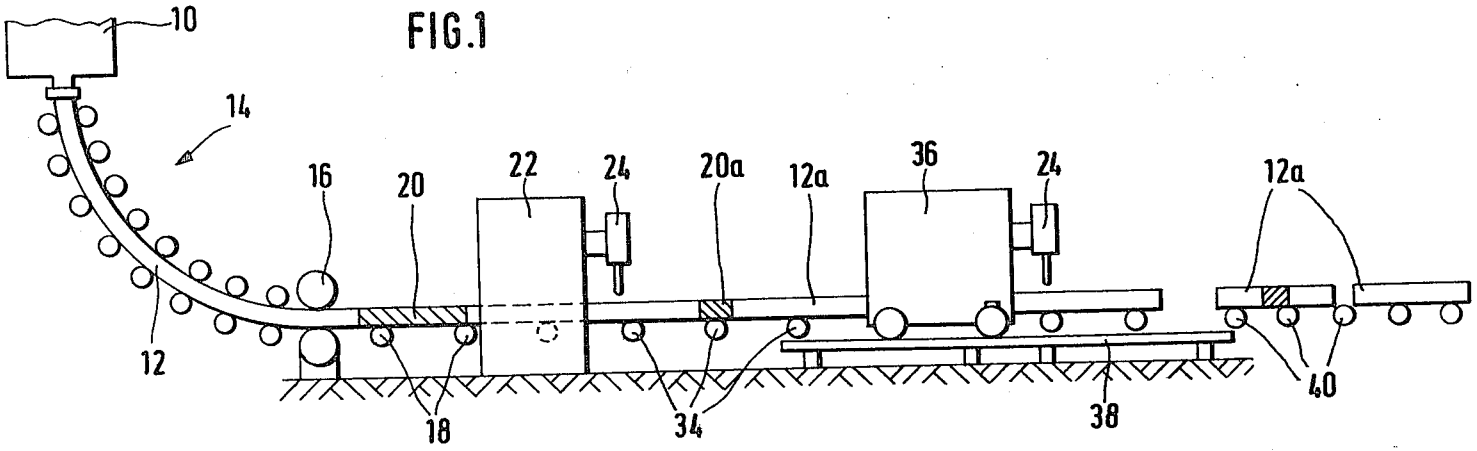
FIG. 1 is an elevation view schematically illustrating a device according to the present invention.

From a continuous casting plant 10 (not shown in detail) the work piece 12 to be processed (slab, block, etc.) comes in the form of an endless cast strip into a bending roller bed 14, which consists of a large number of roller pairs, through which the strip coming vertically from the continuous casting plant is bent to a horizontal strip. At the end of the said bending section, there is a so-called straightening roller bed 16.

Behind the straightening roller bed 16, the strip 12 is taken up by support rollers 18, over which the strip is now moved further at the speed of the casting. The breadth of such a cast strip, e.g., 2.50 m, is illustrated by a shaded zone 20.

In the zone of the first support roller pairs 18 there is, according to the present invention, a longitudinal flame cutting device 22. The strip 12, which had previously been of excessive width, is subdivided by this device into two or more endless longitudinal bands, which are designated as 12*a* for easier understanding. The shaded area 20*a* indicates the breadth of such a longitudinal band 12*a*.

Figure 2:
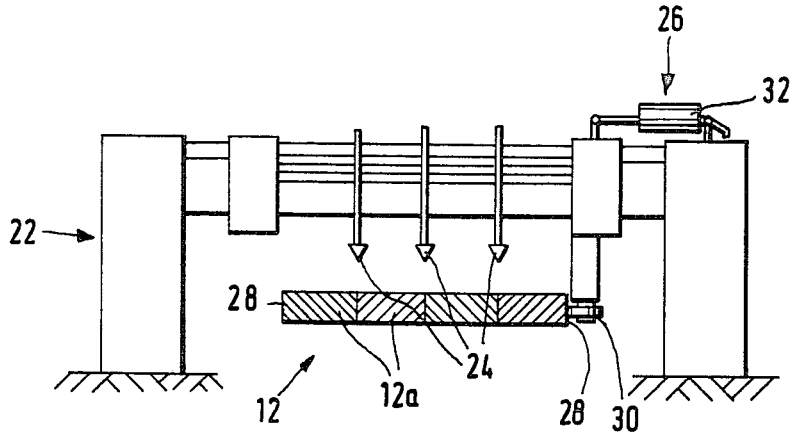
FIG. 2 is a front view of the longitudinal flame cutting device.
Figure 3:
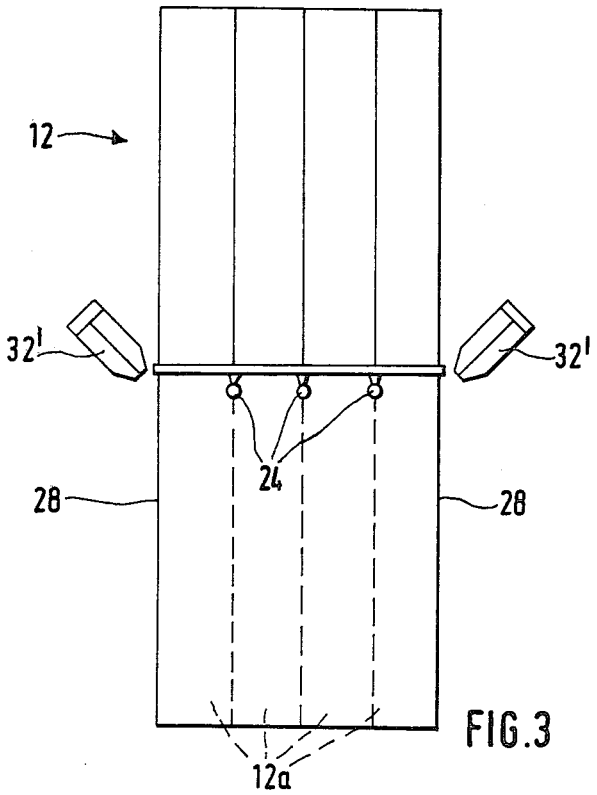
FIG. 3 is a top plan view of a detail of the longitudinal flame cutting device.

In the embodiment shown in FIGS. 2 and 3, there are three flame cutting torches 24 in the longitudinal flame cutting device 22. By means of torches 24, the strip 12 is subdivided into individual, equal longitudinal bands 12*a*. In order to ensure that the strip 12 is subdivided into equal longitudinal bands 12*a*, the cutting torches 24 are integrated into the one unit, which—as shown in FIG. 2—are connected with a lateral guiding device 26. This lateral guiding device 26 consists essentially of a guide roller 30 lying against the lateral surface 28 of the strip 12, which said guide roller is steadily pressed against the said lateral surface 28 by a pneumatic (hydraulic) device 32. A change in the position of the guide roller 30 also results in a corresponding change in the position of the interlinked cutting torches 24, so that it is thus guaranteed that the individual cutting lines are always parallel to the lateral surface 28 serving as a reference plane.

Due to the inhomogeneous heat supply during the longitudinal flame cutting process, especially in the outer zone of the strip 12, so-called preheating torches 32' are installed in the zone of the cutting torches 24 (shown in FIG. 3, but not in FIG. 2). The bilateral heat supply to the longitudinal bands, which is necessary especially in the case of narrow longitudinal bands, is brought about by the said preheating torches, so that the buckling of the (outer) longitudinal band 12*a* during the longitudinal flame cutting process is thereby prevented effectively.

The individual longitudinal bands 12*a* now run over the intermediate roller bed 34 to the transversal flame cutting device 36 installed immediately behind it, which transversal flame cutting device is movable on the guide rails 38.

The transversal flame cutting device 36 moves forward during the cross cutting of the individual longitudinal bands 12*a*, synchronously with the casting speed. This synchronous movement of the device 36 can be brought about by clamping the said device to one or several longitudinal bands, by placing the said device onto the longitudinal bands, or via an electrical wave (i.e., indirectly). These solutions for the synchronous movement are known, per se, and will not be discussed separately here.

At the end of the cutting section determined by the guide rails 38, the transversal flame cutting device 36 returns into its left end position shown in FIG. 1, while the longitudinal bands 12*a*, which are now cut to the corresponding length, are taken up by the discharging rollers 40, and fed to the further processing, e.g., rolling.

In summary, optimally utilize continuous casting plants, ever-increasing casting cross-sections are used, whereby the cast strip reaches a dimension (breadth) which often forbids the further processing in the rolling mills. To solve this problem, a longitudinal flame cutting device 22 is provided behind or downstream from the continuous casting plant 10, and the longitudinal device is followed immediately by a transversal flame cutting device 36. Through this special arrangement (first longitudinal cutting, and then cross cutting), the small overall space requirement of the entire equipment is guaranteed.

What is claimed is:

1. In a device for cutting a work piece such as a slab or block manufactured continuously in a continuous casting plant wherein said device has both a flame cutting device for cross cutting and another flame cutting device for longitudinal cutting, the improvement being that said longitudinal cutting device being downstream from said continuous casting plant as seen in the direction of the work piece discharge from said plant, said traversal cutting device for the cross cutting of the work pieces into bands being installed immediately downstream from said longitudinal cutting device, laterally mounted preheating torches being installed on said longitudinal flame cutting device, and the cutting torches of said longitudinal flame cutting device being connected with a lateral guide roller which is in contact with the lateral surface of the continuously moving work piece.

2. Device according to claim 1, characterized in that the longitudinal flame cutting device is installed in fixed position behind the straightening roller bed of said continuous casting plant.

3. Device according to claim 1, characterized in that said transversal flame cutting device is movably installed.

4. Device according to claim 1, characterized in that said transversal flame cutting device is movably installed.

* * * * *